United States Patent [19]

Bernot et al.

[11] 4,407,658

[45] Oct. 4, 1983

[54] GAS DISCHARGE DISPLAY DEVICE SEALING METHOD FOR REDUCING GAS CONTAMINATION

[75] Inventors: Anthony J. Bernot, Gilbert; Kenneth Brown, Tempe, both of Ariz.

[73] Assignee: Beckman Instruments, Inc., Fullerton, Calif.

[21] Appl. No.: 239,292

[22] Filed: Mar. 2, 1981

[51] Int. Cl.[3] ..... H01J 9/18

[52] U.S. Cl. ..... 445/25; 228/221; 445/44

[58] Field of Search ..... 29/25.13; 316/19, 20; 156/87; 228/286, 104, 145, 146, 221

[56] References Cited

U.S. PATENT DOCUMENTS

| | | | |
|---|---|---|---|
| 3,633,267 | 1/1972 | Kent et al. | 228/221 X |
| 3,656,225 | 4/1972 | Bereza | 228/221 X |
| 3,778,126 | 12/1973 | Wilson | 316/20 |
| 3,778,127 | 12/1973 | Langston, Jr. et al. | 445/25 |

OTHER PUBLICATIONS

Chaikin et al., *IBM Technical Disclosure Bulletin,* vol. 18, No. 19, Feb. 1976, pp. 2934–2935.

*Primary Examiner*—K. J. Ramsey

*Attorney, Agent, or Firm*—R. J. Steinmeyer; F. L. Mehlhoff; William H. May

[57] ABSTRACT

A method of constructing a gas discharge display device in such a manner that contaminants found within the completed display are significantly reduced. The process for assembly of the display incorporates the utilization of a spacer member having a higher melting temperature than the display's perimeter seal and is designed to hold the plates apart without letting certain portions of the sealing material contact the opposing substrate. The use of the spacer member of high temperature material permits a higher temperature to be achieved in the vacuum furnace for evacuating the contaminants produced by out-gassing of impurities in the dielectric and conductive materials as well as the glass substrates and the sealing material. The sealing time for the display after evacuation is shortened to prevent or greatly reduce the possible entrapment of impurities in the display during the higher temperature final sealing step.

6 Claims, 4 Drawing Figures

GAS DISCHARGE DISPLAY DEVICE SEALING METHOD FOR REDUCING GAS CONTAMINATION

BACKGROUND OF THE INVENTION

The present invention is directed to a method for constructing a gas discharge display device and, more particularly, is directed to a method of constructing the gas discharge display so that the amount of contaminants found within the sealed envelope of the finished display is significantly reduced.

In the construction of gas discharge display devices it is necessary to create a hermetically sealed envelope to contain the ionizable gas utilized to display various symbols depending upon the addressing of electrodes within the display. However, the useful life as well as the quality of performance of the display is dependent among other things upon the quality of the gas mixture within the sealed envelope. The more contaminants found within the sealed envelope, the greater the likelihood the quality of operation and the life of the display will be reduced.

In some instances it is possible to getter out the gas contamination after sealing. This is accomplished by the use of some type of getter material in the display which is activated by external energy to remove a certain amount of impurities within the inert gas atmosphere. However, as products are developed with greater operational requirements, there is a definite requirement for very clean fill gas and tight resolution of the seal frit for sealing of the display. Without some means for being able to adequately seal the display device without contamination within the envelope atmosphere, the ability to produce such new products will not exist.

Much of the impurity and comtamination of the envelope atmosphere occurs during the evacuation, backfilling and sealing process wherein a phenomena called out-gassing occurs. Various dielectric and conductive layer materials are placed on the interior of the plates that form the display envelope. These layers are used to form the electrode patterns to establish the desired visual characters. Also, sealing material is placed around the perimeter of the plates. The face plate and base plate used to form the display device are typically glass plates similar to the material used for making glass windows. As the temperature increases during this process, outgassing of impurities and contaminants from the dielectric and conductive layers as well as the glass plates and sealing material occurs. The longer the device is subjected to high temperature, the greater the amount of contaminants will be emanated from the layers, sealing material and the glass plates.

One process recently used for evacuating, backfilling and sealing a plurality of gas discharge displays at one time incorporates the use of a vacuum furnace wherein the furnace creates a vacuum to evacuate the entire atmosphere within the furnace including the atmosphere between the plates through some type of fill port in one of the plates. After the evacuation process, the interior of the furnace chamber is filled with the inert ionizable gas which back-fills the displays through their respective fill ports. After the insertion of the inert ionizable gas within the display, it is necessary to hermetically seal each of the envelopes of the displays. The temperature must be raised to a high level in order to soften the perimeter seal material around the display as well as the seal material in the fill port. Typically, when the perimeter seal becomes soft, a seal is created. However, this seal generally occurs too soon and traps the contaminants being out-gassed from material within the envelope formed by the plates. Usually the heating is continued to ensure the final hermetic seal. This requires additional time and slightly higher temperature which results in the generation of more contaminants which are trapped within the closed envelope.

Therefore, it is important to devise some method to allow for the escape of the contaminants between the plates during the heating process used for melting and softening the perimeter seal. Also it is necessary to establish some way to reduce either the high temperature required for final sealing and/or to reduce the time at which the display must be subjected to an extremely high temperature to establish the final hermetic seal.

SUMMARY OF THE INVENTION

The present invention incorporates the use of a spacer member that is thicker than the perimeter seal placed on gas display plates during construction, so that the plates are held apart sufficiently to allow a relatively large gap for the escape of contaminants generated during the heating process for melting and softening the perimeter seal. Consequently, the contaminants from out-gassing which occurs during this process are allowed to escape from between the plates rather than being trapped in a semi-hermetic seal which occurs during the heating when the plates are not held slightly apart.

The spacer member is designed to have a particular melting point, so that, when the temperature within the vacuum furnace reaches the melting point of the spacer member, the plates will quickly close and create a hermetic seal. Some type of biasing means may be used on the plates to force the plates to close more quickly once the spacer member melts.

The present process is designed to keep the plates apart longer in the vacuum stage at a higher temperature which will melt the perimeter seal. After the vacuum stage is completed, the temperature is raised to a higher temperature during backfill of the ionizable gas for a quick period of time to melt the spacer member and obtain the final seal. Therefore, during the high temperature vacuum stage, the most significant amount of contaminants will escape from between the plates while they are kept apart by the spacer member and only a smaller amount of contaminants will be trapped during the very short period at the higher temperature for the final hermetic seal.

DETAILED DESCRIPTION OF THE INVENTION

Figure 1:
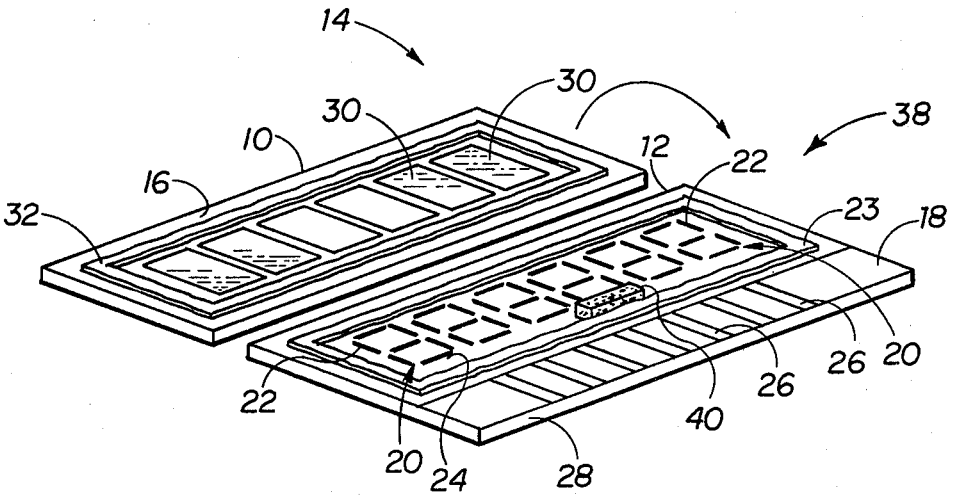
FIG. 1 is a perspective view of a display device prior to assembly of the plates, showing the interior surface of each of the plates.

In FIG. 1 the face plate 10 and the base plate 12 of a gas discharge display 14 are shown prior to assembly with the interior surfaces 16 and 18 of the respective face plate 10 and base plate 12 exposed. Located on the interior surface 18 of the base plate 12 is an electrode pattern comprised of a plurality of character positions 20 formed by a series of separate cathode electrode segments 22. A dielectric layer 24 covers the electrode conductive runs which have been screened on the base plate 12 to properly interconnect the appropriate cathode segments 22 with the terminal pads 26 located along the longitudinal edge 28 of the base plate 12. Both the cathode electrode segments 22 and the dielectric layer 24 are preferably screen printed on the interior surface 18 of the base plate 12. However, it should be noted that the electrode pattern could be formulated by discrete metal pieces to which are connected discrete metal runners for electrical interconnect to the terminal pads either along the edge 28 or through the opposite side of the plate 12. Located around the periphery of the character positions 20 is a perimeter sealing frit 23.

Deposited on the interior surface 16 of the face plate 10 are a plurality of anode electrodes 30 which are designed to operate in conjunction with each of the character positions 20 on the base plate 12. The anodes 30 are preferably made of a transparent conductive material such as tin oxide. Each of the anodes is connected to a respective terminal pad 26 along the base plate 12 by an interconnect clip (not shown) placed between the plates when they are assembled. The face plate is transparent to establish a viewing window for the display. Located around the periphery of the anodes is a sealing frit 32 which will match with the corresponding base plate sealing frit 23 when the plates are in face-to-face relation with each other. The sealing frits 32 and 23 are preferably screen printed onto respective face plate and base plate. Glass beads (not shown) are in the sealing frit material so that, when the frit melts, the glass beads will establish the necessary spacing between the plates when they are assembled. It should be noted that the cathode electrodes 22 and the anodes 30 could be placed on base plate 12 in a coplanar relationship.

Figure 2:
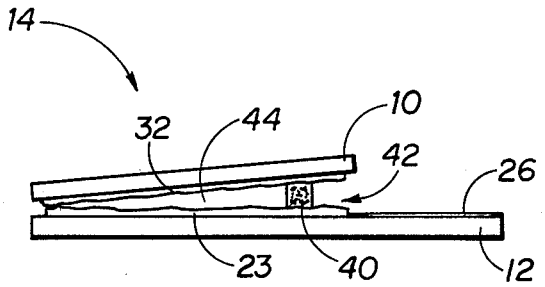
FIG. 2 is an end view of the plates when they are in face-to-face relation prior to final seal.

Prior to assembly of the plates a spacer member or pill 40 is positioned on one of the plates such as the base plate 12 slightly inside the perimeter seal material 23 along the terminal edge 28 of the substrate 12. As shown in FIG. 2, when the plates are placed in a generally face-to-face relation, the spacer member 40 acts as a holding member to maintain a gap 42 between the respective sealing materials 32 and 23 along the perimeter of the face plate 10 and the base plate 12. Therefore, the spacer member 40 has a thickness greater than the combined thickness of the sealing material 23 on the substrate 18 and the sealing member 32 on the face plate 16.

Once the face plate 10 and the base plate 12 are placed in their face-to-face relationship as shown in FIG. 2, the display 14 is inserted along with several other displays into a vacuum furnace. After the closure of the vacuum furnace, a vacuum is created to evacuate the atmosphere within the furnace as well as the atmosphere within the interior envelope 44 of each of the displays 14. During this evacuation step the temperature is increased to a relatively high level in order to heat the sealing material 32 and 23 to a molten state which is necessary for providing a seal between the plates to establish a hermetically sealed interior envelope 44 when the plates are closed. The melting temperature of the sealing material 32 and 23 can range between 450° C. to 515° C. depending upon the particular material utilized.

Figure 3:
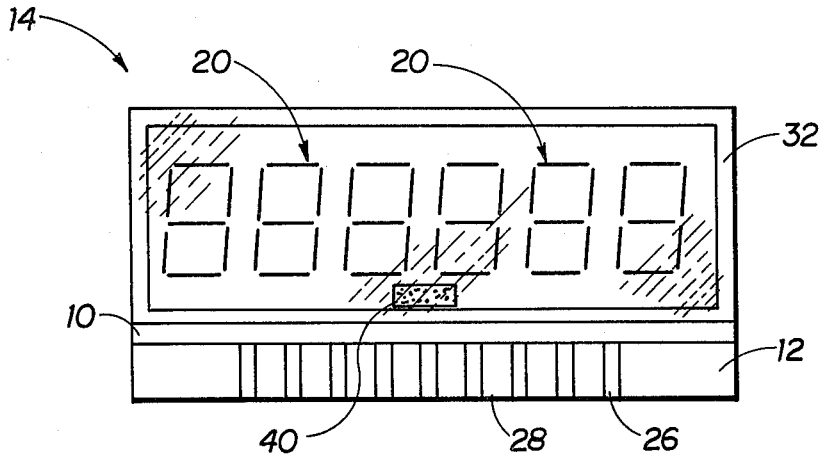
FIG. 3 is a planar view of the plates in face-to-face orientation prior to final seal showing the general location of the spacer member.

As the temperature is increased to this high level, out-gassing of contaminants from the cathode and anode material as well as from the sealing material and the dielectric layer 24 will occur. Other impurities from the plates which are preferably made of ordinary window glass will also be driven off. It is important that these impurities not be trapped within the envelope 44. The spacer member 40 provides the gap 42 between the plates along the entire terminal edge 28 as shown with respect to FIGS. 2 and 3.

The spacer member 40 is preferably a small rectangular solid block made of some type of material which has a higher melting temperature than the melting temperature of the perimeter sealing material 32 and 23. An exemplary type of material utilized for the spacer member could be either solder glass whose softening point is 480° C. or a eutectic metal alloy whose melting temperature is between 480° C. and 495° C. One example of a glass solder pill or spacer member would be Owens-Illinois FMS-P4 Solder Glass. An example of a eutectic metal alloy would be one composed of indium antimony.

While the temperature is increased during the vacuum or evacuation stage of the process within the vacuum furnace, the impurities are allowed to escape through the gap 42 as shown in FIG. 2. When the sealing frit material 23 and 32 has almost reached its flow point for sealing, the temperature can be quickly raised to a higher level for a relatively short period of time, so that the spacer member 40 can be quickly melted. The higher level temperature for melting the spacer member can be in the range of 465° C. to 530° C. depending upon the material used for the spacer member. The material chosen for the spacer member 40 should have a melting point approximately 10° C. to 20° C. higher than the melting point for the material chosen for the sealing material 23 and 32.

After the spacer member 40 melts, the face plate will quickly mate with the base plate, allowing the perimeter sealing materials 32 and 23 to come into contact with each other completely around the periphery of the display and establish a hermetic seal for the interior envelope 44. It may be preferable to use some type of biasing means on the plates to force them to close as quickly as possible once the spacer member melts. One example would be the spring clips shown in patent application Ser. No. 096,946 filed Nov. 23, 1979 in the name of Henry E. Franklin.

Because the higher level temperature is maintained for a short period of time, out-gassing of the material on the plates is minimized during this time period which occurs after the plates have been closed and the seal has been essentially established. It has been found that the use of the spacer member allows for approximately a thirty percent (30%) reduction in the amount of time required for a high level temperature. It is considered that the time period at the higher level temperature is the most critical time period which must be kept to a minimum in order to reduce the amount of out-gassing of impurities.

Figure 4:
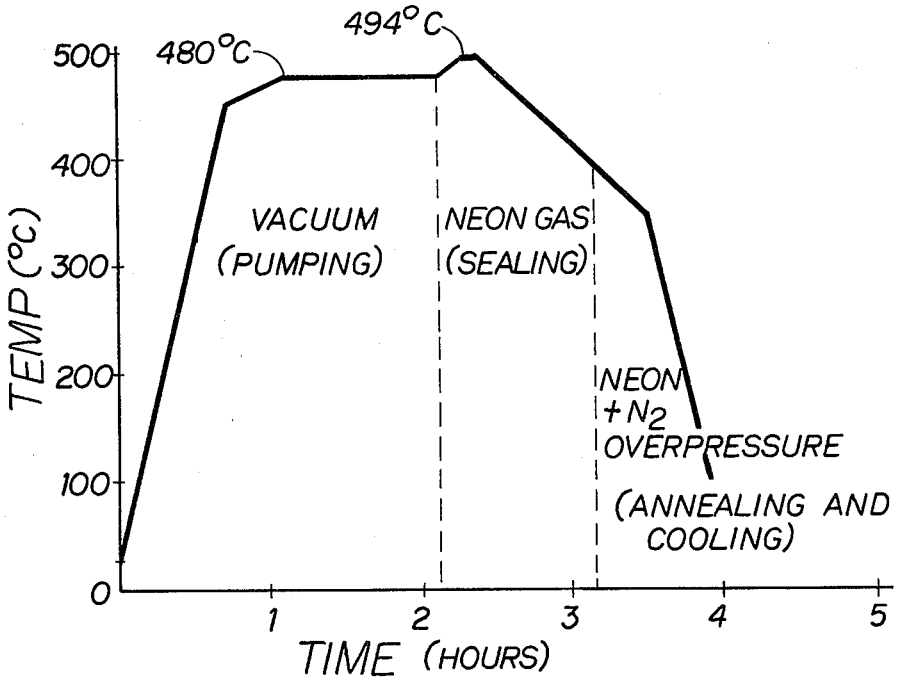
FIG. 4 graphically shows the process of the present invention.

Reference is made to FIG. 4 showing a graphic representation of exemplary steps taken within the vacuum furnace. The vacuum in the furnace occurs once the furnace has been sealed. Concurrently, the temperature is increased from zero to 480° C. over a period of approximately 60 minutes and is held there for an additional 60 minutes for softening the perimeter seal. Subsequently, the temperature is raised to a higher level temperature of 494° C. for a period of approximately 5 minutes to melt the spacer member and allow the plates to close to form a hermetically sealed envelope. After that time period the displays are allowed to gradually cool for removal from the furnace approximately two hours later. FIG. 4 is shown for exemplary purposes and it is envisioned that the process of the present invention could be accomplished with the temperatures and time periods slightly different.

What is claimed is:

1. A method for constructing a gas discharge display device having a face plate and a base plate forming an interior envelope with a viewing window and containing electrode means, said method comprising the steps of:

forming a perimeter seal around said viewing window of said display on at least one of said plates;

placing spacer means on one of said plates;

assembling said plates in face-to-face relation to form said envelope;

maintaining with said spacer means the majority of said perimeter seal out of contact with the other of said plates to provide a gap between said perimeter seal and said other of said plates;

placing said assembled plates in a vacuum furnace;

heating said furnace to a first temperature range to soften said perimeter seal;

outgassing contaminants from said electrode means and from said perimeter seal;

simultaneously with said first temperature heating step creating a vacuum in said furnace to remove said contaminants through said gap and out of the atmosphere between said plates;

introducing an ionizable gas between said plates;

heating said furnace to a second temperature range higher than said first temperature range to melt said spacer means; and moving said plates in contact with each other around said perimeter seal to establish a hermetically sealed display.

2. A method for constructing a gas discharge display device as defined in claim 1, and additionally comprising the step of placing biasing means on said plates after said assembling step in order to bias said plates toward each other.

3. A method of constructing a gas discharge display device as defined in claim 1, wherein said step of heating said furnace to said second temperature range comprises an increase of less than 20° C. above said first temperature range.

4. A method of constructing a gas discharge display device as defined in claim 1, wherein said first temperature range is approximately 450° C. to 515° C.

5. A method of constructing a gas discharge display device as defined in claim 1, wherein said second temperature range is 465° C. to 530° C.

6. A method of constructing a gas discharge display device as defined in claim 1, and additionally comprising the step of maintaining said second temperature range for a period of not more than five minutes.

* * * * *